US005883364A

United States Patent [19]

Frei et al.

[11] Patent Number: 5,883,364

[45] Date of Patent: Mar. 16, 1999

[54] CLEAN ROOM HEATING JACKET AND GROUNDED HEATING ELEMENT THEREFOR

[76] Inventors: Rob A. Frei, 7709 Pembrook Dr., Reynoldsburg, Ohio 43068; Heath Watson, 1278 Northridge Rd., Columbus, Ohio 43224; Clark Garn, 388 Celina Rd., Columbus, Ohio 43228; Steve Hall, 79 West St., West Jefferson, Ohio 43162; Larry Marcum, 6656 Darby Blvd., Darbydale, Ohio 43123

[21] Appl. No.: 702,906

[22] Filed: Aug. 26, 1996

[51] Int. Cl.[6] ..... H05B 3/58; H05B 3/34

[52] U.S. Cl. ..... 219/535; 219/549

[58] Field of Search ..... 219/528, 529, 219/534, 535, 545, 548, 149; 338/66, 214; 124/78

[56] References Cited

U.S. PATENT DOCUMENTS

| | | | |
|---|---|---|---|
| 2,529,914 | 11/1950 | Challenner | 338/214 |
| 3,209,128 | 9/1965 | Chapman, Jr. | 338/214 |
| 3,393,297 | 7/1968 | Hart | 219/549 |
| 3,904,850 | 9/1975 | Johnson | 219/535 |
| 4,152,577 | 5/1979 | Leavines | 219/535 |
| 4,242,573 | 12/1980 | Batliwalla | 219/528 |
| 4,281,238 | 7/1981 | Noma et al. | 219/535 |
| 4,468,557 | 8/1984 | Bylin et al. | 219/535 |
| 4,576,827 | 3/1986 | Hastings et al. | 338/214 |
| 4,605,043 | 8/1986 | Grenier | 138/149 |
| 4,725,717 | 2/1988 | Harrison | 219/549 |
| 4,850,397 | 7/1989 | Grenier | 138/149 |
| 4,922,083 | 5/1990 | Springs et al. | 219/549 |
| 4,944,987 | 7/1990 | Cordia et al. | 428/192 |
| 4,979,643 | 12/1990 | Lipisko et al. | 222/83 |
| 5,125,359 | 6/1992 | Barale et al. | 118/725 |
| 5,197,595 | 3/1993 | Coultas | 219/535 |
| 5,300,760 | 4/1994 | Batliwalla et al. | 219/549 |
| 5,329,095 | 7/1994 | Okase | 219/390 |
| 5,346,555 | 9/1994 | Nunotani et al. | 118/724 |
| 5,432,322 | 7/1995 | Ingram et al. | 219/528 |
| 5,471,033 | 11/1995 | DiPaolo et al. | 219/388 |
| 5,519,490 | 5/1996 | Nakata et al. | 356/338 |
| 5,558,794 | 9/1996 | Jansens | 174/108 |
| 5,646,370 | 7/1997 | Perkins | 174/78 |

*Primary Examiner*—Teresa Walberg
*Assistant Examiner*—Sam Paik
*Attorney, Agent, or Firm*—Porter, Wright Morris & Arthur

[57] ABSTRACT

The clean room heating jacket comprises an inner liner and an outer cover formed from flexible, static-dissipative, substantially particle-free fabric, an intermediate layer of resilient, substantially fiber-free insulative material and a flexible heating element disposed between the inner liner and the intermediate insulative layer. The inner liner, intermediate insulative layer and outer cover are configured to conform generally to the shape and size of the processing vessel for which the heating jacket is adapted. The jacket is of clamshell design wherein relatively opposing free edge portions are disposed in closely spaced relation to one another when the jacket is in a closed position and in generally planar, outwardly spaced relation to one another when the jacket is in an open position. A flap is attached to the outer cover in overlying relation to one of the free edge portions, and VELCROC® hook and loop material is secured to the underside of the flap and to the outer cover adjacent to the other opposing edge portion to releasably hold the jacket in the closed position in surrounding relation to the processing vessel. The heating element comprises one or more heat-generating core wires, a layer of insulative material wrapped around the core wire(s), a first thread layer wrapped around the insulative layer, a ground conductor wrapped around the insulative layer and second and third thread layers wrapped around the ground conductor. The core wire(s), insulative layer, ground conductor and various thread layers are disposed in a serpentine pattern, and the heating element is arranged in a plurality of electrically connected strips secured to the inner liner of the jacket.

14 Claims, 4 Drawing Sheets

CLEAN ROOM HEATING JACKET AND GROUNDED HEATING ELEMENT THEREFOR

BACKGROUND OF THE INVENTION

The present invention relates to electrical resistance heating apparatus and more particularly to heating jackets suitable for use in clean room environments and to the heating elements employed therein.

It has been found that in processing semiconductor wafers, it is advantageous to heat portions of the process equipment located downstream, and possibly upstream, of a horizontal diffusion-type chemical vapor deposition (CVD) chamber. In this manner, the condensation of compounds such as silicon nitride, ammonium and dichloroxylene from a gaseous to a crystalline state is avoided or substantially reduced, thereby assisting in their recapture and/or further availability for ongoing process reactions. Heating jackets disposed in surrounding relation to the CVD chamber are well known; however, due to their high heating capacity and cumbersomeness, these jackets are not well suited for use on outlying pipes and other vessels where heating requirements are more moderate and where there is a need to install and remove the jacket relatively quickly. In addition, there may be several vessels connected either directly or indirectly to the primary CVD chamber, so the cost of covering these outlying structures with high capacity heating jackets could be prohibitive. Thus, there was a need for a relatively modest heating jacket in terms of heating capacity and cost, as well as one which was easily installed and removed.

Heretofore, moderate range heating jackets which might otherwise satisfy the foregoing need have contained a substantial amount of fiberglass and/or have tended to carry a static surface charge. These conventional moderate range heating jackets were unsuited for use with semiconductor processing equipment due to their tendency to introduce an unacceptable level of particles or fibers into the surroundings. Thus, there was a need for a heating jacket comprising static-dissipative, generally particle-free materials suitable for use in a clean room environment.

In addition, the heating elements employed in conventional moderate range jackets were typically ungrounded. However, NST Standards now require, or are expected to soon require, heating elements adapted for use in semiconductor production and other industrial processes to be fully or continuously grounded. Thus, there was also a need to devise a grounded heating element suitable for use in a moderate range heating jacket.

SUMMARY AND OBJECTS OF THE INVENTION

The present invention is a heating jacket adapted to be mounted on a processing vessel. The present heating jacket basically comprises: (1) a flexible inner liner formed from a static-dissipative, substantially particle-free fabric; (2) a flexible intermediate layer of resilient, substantially fiber-free insulative material; (3) a flexible heating element positioned between the inner liner and the intermediate layer of insulative material; (4) a flexible outer cover formed from the static-dissipative, substantially particle-free fabric; (5) the inner liner, the intermediate layer of insulative material and the outer cover being configured to conform generally to the shape and size of the processing vessel; (6) the heating jacket being provided with a pair of relatively opposing free edge portions for readily installing the jacket on and removing it from the processing vessel; and (7) readily releasable, cooperative fasteners attached to the outer cover adjacent to the free edge portions of the heating jacket.

Preferably, the heating element comprises: (1) one or more elongated, heat-generating core wire(s); (2) an insulative layer wrapped around the core wire(s); (3) a first layer of thread wrapped around the insulative layer; (4) a ground conductor wrapped around the first layer of thread; (5) a second layer of thread wrapped around the ground conductor; (6) a third layer of thread wrapped around the second layer of thread; (7) the core wire(s) and overlying layers being configured to define serpentine loops; and (8) one or more components for holding the serpentine loops in spaced relation to one another.

Primary objects of the present heating jacket are: (1) ease of installation and removal; (2) relatively moderate heating capacity and production costs; (3) clean room compatibility; and (4) conformity with current or anticipated electrical safety standards.

DETAILED DESCRIPTION OF THE PREFERRED EMBODIMENT

Figure 2:
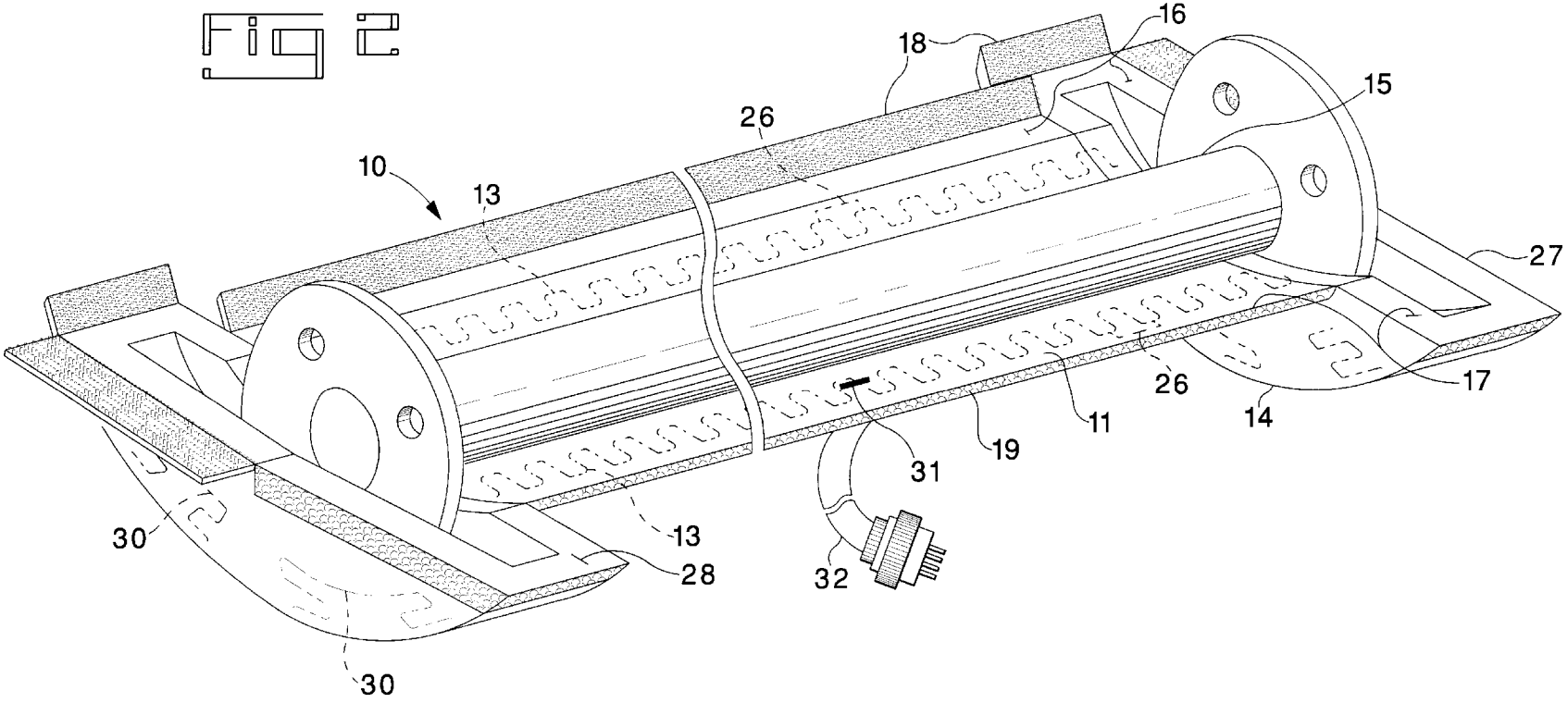
FIG. 2 is a perspective view wherein the present heating jacket is disposed in an open position.
Figure 3:
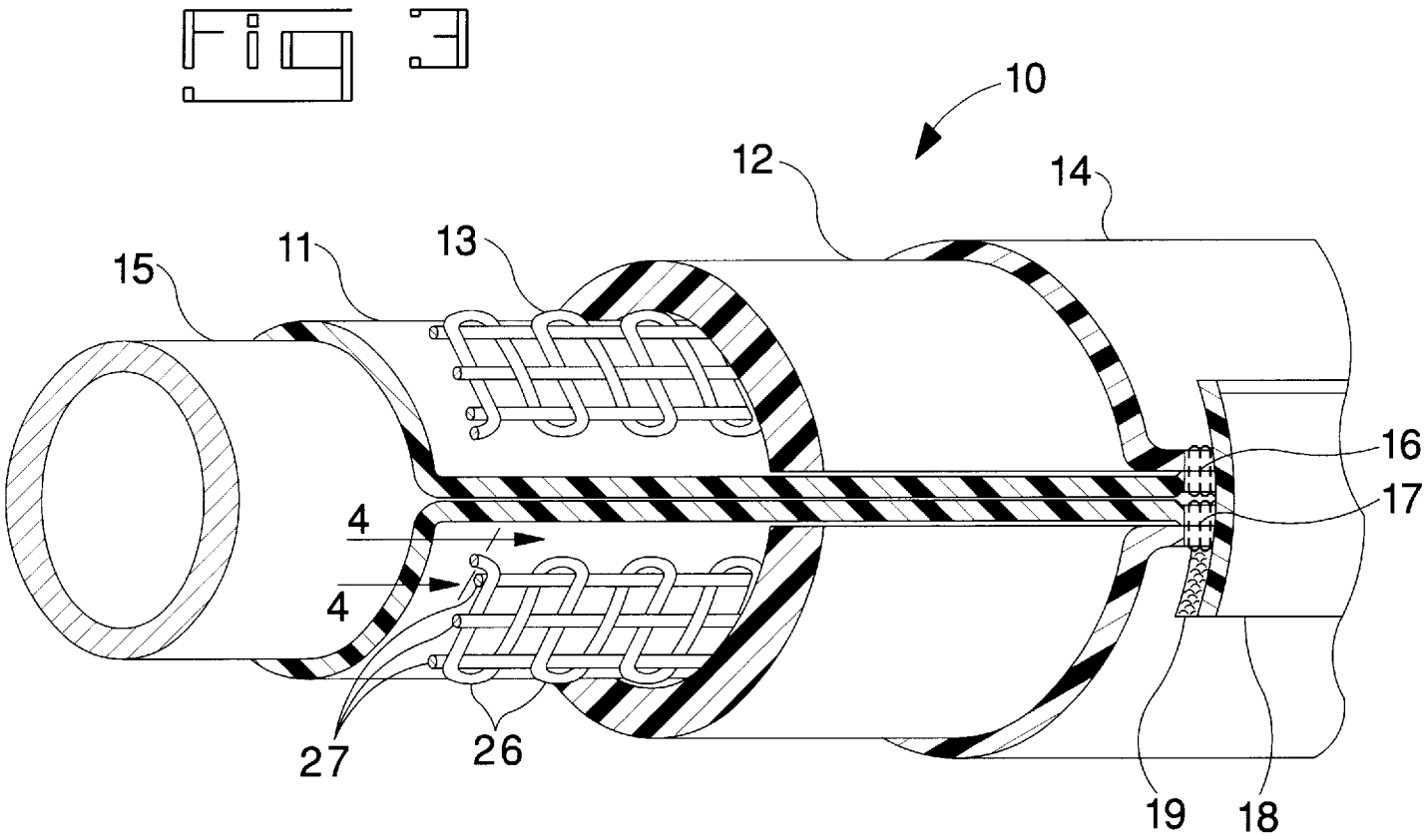
FIG. 3 is an enlarged, cutaway sectional view taken along lines 3—3 of FIG. 1 to particularly illustrate the layers of the present heating jacket.

As illustrated in FIGS. 2 and 3, a heating jacket, generally designated 10, according to the present invention basically comprises a flexible inner liner 11 formed from a static-dissipative, substantially particle-free fabric; a flexible intermediate layer 12 of resilient, substantially fiber-free insulative material; a flexible heating element 13 positioned between the inner liner 11 and the intermediate layer 12 of insulative material; a flexible outer cover 14 formed from the static-dissipative, substantially particle-free fabric; the inner liner 11, the intermediate layer 12 of insulative material and the outer cover 14 conforming generally to the shape and size of a processing vessel 15 to be heated; the heating jacket 10 having a pair of relatively opposing free edge portions 16, 17 for readily installing the heating jacket on and removing it from the processing vessel 15; and readily releasable, cooperative fasteners 18, 19 secured to the outer cover 14 adjacent to the free edge portions 16, 17 of the heating jacket 10.

Preferably, the inner liner 11 and the outer cover 14 are formed from a man-made, multifilament sheet structure or fabric such as NOMEX®, a product of E. I. Du Pont de Nemours and Company, Wilmington, Del. The NOMEX material is treated with an antistatic compound such as CHEMSTAT®, a product of Chemax, Inc., Piedmont, S.C. The preferred fabric for the inner liner 11 and the outer cover 14 is distributed by Stern & Stern, New York, N.Y. under the brand name CHEMSTAT 919. The fabric is a 2/2 twill pattern with a ¼" grid. It is suitable for use within an ambient to 316° C. (600° F.) temperature range.

Preferably, the intermediate layer 12 of insulative material is formed from nonfibrous elastomeric sheet material such as PORON®, a product of Rogers Corporation, Rogers, Conn. or from nonfibrous silicone foam sheet material such as EXOBLOC® BF, a product of Bisco Products, Inc., Elk Grove Village, Ill. The temperature range for the PORON insulation is ambient to 210° C. (450° F.); the temperature range for the EXOBLOC® BF material is ambient to 232° C. (450° F.).

Figure 4:
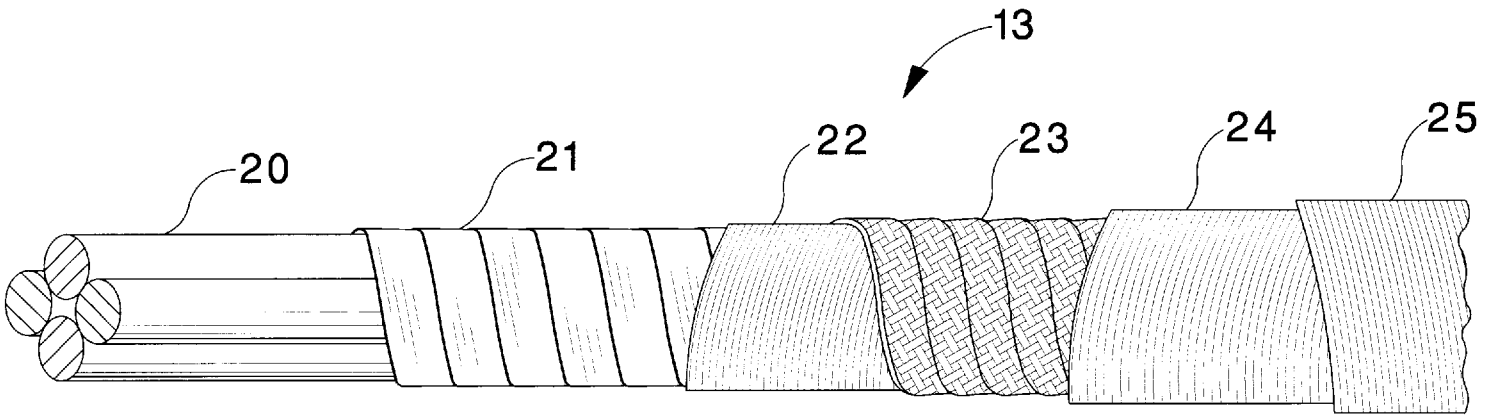
FIG. 4 is a further enlarged, cutaway sectional view taken along lines 4—4 of FIG. 3 to particularly illustrate the layers of the heating element.

As illustrated in FIG. 4, the flexible heating element, generally designated 13, comprises several elongated, heat-generating core wires 20, an insulative layer 21 wrapped around the core wires 20, a first layer of thread 22 wrapped around the insulative layer 21, a ground conductor 23 wrapped around the first layer of thread 22, a second layer of thread 24 wrapped around the ground conductor 23 and a third layer of thread 25 wrapped around the second layer of thread 24. As illustrated in FIG. 2, the heating element 13 is formed into serpentine loops 26, and a fourth layer or set of threads 27 is/are intertwined between the loops 26 to hold them in spaced relation to one another. Alternatively, the serpentine loops 26 may be embedded in silicone rubber (not shown) to hold them in spaced relation to one another.

For high voltage applications, the insulative layer 21 is preferably formed from a strong dielectric material such as KAPTON® film, a product of E. I. Du Pont de Nemours and Company, Wilmington Del. In lower voltage applications, an additional thread layer (not shown)may be substituted for the KAPTON wrap. Typically, fiberglass thread is employed in each of the thread layers or sets 22, 24, 25 and 27. However, for higher temperature applications, fiberglass thread incorporating SAMOX® insulation, a product of Briskheat Corporation, Columbus, Ohio or TEFLON®, a product of E. I. Du Pont de Nemours and Company, Wilmington, Del., is recommended.

Preferably, the ground conductor 23 is a tin/copper braid comprising 32 strands of 37 gauge wire and provides at least 85% coverage of the substrate. The core wires 20 are preferably nichrome based alloys such as Tophet and Kanthal. The gauge or size of the core wires 20 depends upon the particular process and apparatus for which the present heating jacket is intended. Likewise, the width of the heating element 13 ranges between 0.5 in. and 3.0 inches, and the number of picks or serpentine loops 26 may be 8, 10 or 12 picks per inch, depending upon the particular application for which the jacket is designed.

Figure 1:
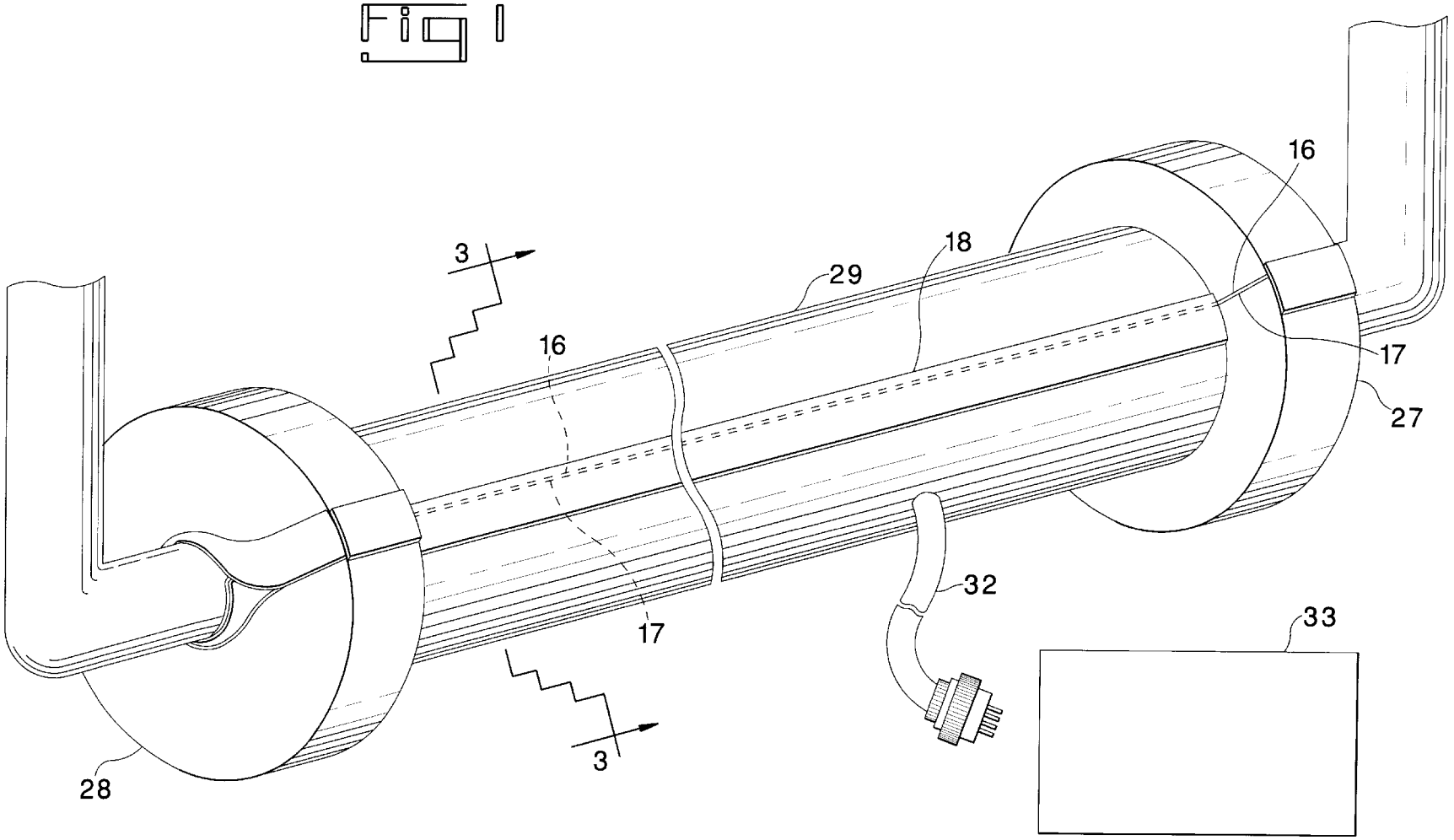
FIG. 1 is a perspective view wherein a heating jacket according to the present invention is disposed in a closed position.

As illustrated in FIGS. 1, 2 and 3, the processing vessel 15 is an elongated stainless steel pipe formed with end flanges, and the present heating jacket 10 comprises a pair of truncated flange housings 27, 28 and an elongated pipe housing 29 extending therebetween. As can be seen, the heating jacket 10 is of clamshell design in terms of its 180° movement capability between a closed position wherein the opposing edge portions 16, 17 are substantially in contact with, or in closely spaced relation to, one another (FIG. 1), and an open position wherein the opposing edge portions 16, 17 are disposed in substantially the same plane and are spaced as far away from one another as possible (FIG. 2). Each of the inner liner 11, intermediate insulative layer 12 and outer cover 14 are separately constructed from several pieces of the previously described, flexible materials which are sized, shaped, stitched or otherwise fastened together to form interconnected flange and pipe housings 27, 28 and 29 for each layer.

Four elongated sections of the heating element or tape 13 extend in spaced, parallel relation to one another along the entire length of the elongated pipe housing 29 and well into the flange housings 27, 28. The heating tape 13 is either stitched to the constructed inner liner 11 or an elongated, heating tape-receiving pocket (not shown) may be provided in the liner 11. Insulated bridge conductors 30 electrically connect the heating tape sections together in the usual manner. A K- or J-type thermocouple 31 is fastened to the pipe-engaging surface of the inner liner 11, and electrical leads (not shown) extending from the heat-generating core wires 20, the ground braid 23 and the thermocouple 31 are encased in a nylon-sleeved cable 32 for connection to a controller 33, such as a Fuji 116 DIN or Koyo PLC. Alternatively, a conventional thermostat (not shown) may be substituted for the thermocouple 31 and a constant power source may be substituted for the controller 33 when thermal control requirements are less precise.

Once the heating element sections 13 have been secured to the constructed inner liner 11 and the above-described bridges 30, thermocouple 31 and leads have been attached, this subassembly is stitched or otherwise secured to the constructed intermediate insulative layer 12 and the constructed outer cover 14. Flaps 18 formed from the same fabric as employed in the outer cover 14 and the inner liner 111 are then sewn or otherwise attached to portions of the outer cover 14 in overlying relation to free edge portions 16 one side of the heating jacket 10. Strips 18, 19 of readily releasable fastening material, such as VELCRO® hospital-type, hook and loop material, are sewn or otherwise fastened to the undersides of the flaps 18 and to the outer liner 14 adjacent to the free edge portions 17 on the opposite side of the present heating jacket. In this manner, the opposing edge portions 16, 17 are held together when the heating jacket is in the closed position.

In view of the foregoing description, it may be understood that the present heating jacket 10 is well suited for providing well regulated and uniform heat to processing vessels which are operative within a relatively moderate (ambient to 230° C.) temperature range. The present heating jacket 10 may be fabricated at a relatively moderate cost; it is easily installed on and removed from the processing vessel for which it is adapted and it is well suited for use in clean room environments.

It is intended that other, variously shaped processing vessels disposed upstream and/or downstream of the pipe 15 illustrated herein be provided with heating jackets according to the present invention. Each of such additional heating jackets would be shaped and sized to conform to the particular vessel for which it is intended. Thus, while a single preferred embodiment of the present invention has been illustrated and described in some detail, the foregoing disclosure is not intended to restrict or limit unduly the spirit of the invention or the scope of the following claims.

We claim:

1. A heating jacket for use on a processing vessel, said heating jacket comprising:

a flexible, vessel-engaging inner liner formed from non-conductive static dissipative substantially lint-free fabric;

a flexible intermediate layer of resilient, substantially fiber-free insulative material;

a flexible heating element positioned between the inner liner and the intermediate layer of insulative material, said heating element being in direct contact with the inner liner and the intermediate layer of insulative material;

a flexible outer cover formed from the nonconductive static-dissipative lint-free fabric; and said inner liner, intermediate layer of insulative material and outer cover being configured to conform generally to the shape and size of the processing vessel and assembled into a clamshell configuration for repeated installation on and removal from the processing vessel.

2. The heating jacket according to claim 1, wherein the inner liner and the outer cover are bound together along each of the opposing edge portions of said heating jacket.

3. The heating jacket according to claim 1, wherein each of the inner liner, intermediate insulative layer and outer cover can be heated to a temperature of at least 200° C. without damaging said inner liner, intermediate insulative layer or outer cover.

4. The heating jacket according to claim 1, wherein each of the inner liner, intermediate insulative layer and outer cover is formed from a plurality of pieces, said pieces being sized, shaped and bound together to conform generally to the shape and size of the processing vessel.

5. The heating jacket according to claim 1, wherein a temperature sensor is mounted on the inner liner and wherein means are provided for electrically connecting said temperature sensor and the heating element to a regulating device.

6. The heating jacket according to claim 1, wherein the fastening means attached to the outer cover comprises a flap bound to the outer cover in overlying relation to one of the opposing edge portions of the heating jacket, a first strip of hook and loop material secured to an underside of the flap and a second strip of hook and loop material secured to the outer cover adjacent to the other of said opposing edge portions.

7. The heating jacket according to claim 6, wherein the flap is formed from the nonconductive static-dissipative, substantially lint-free material.

8. The heating jacket according to claim 1, wherein the heating element comprises:

at least one heat-generating core wire;

an insulative layer wrapped around said at least one core wire;

a first layer of thread wrapped around said insulative layer;

a ground conductor wrapped around said first layer of thread;

a second layer of thread wrapped around said ground conductor;

a third layer of thread wrapped around said second layer of thread;

said at least one core wire, said first, second and third layers of thread and said ground conductor being configured to define a plurality of serpentine loops; and means for holding said serpentine loops in spaced relation to one another.

9. The heating jacket according to claim 8, wherein said insulative layer is comprised of a synthetic resin film having a dielectric strength greater than fiberglass.

10. The heating jacket according to claim 8, wherein said first, second and third layers of thread are each comprised of fiberglass material.

11. The heating jacket according to claim 8, wherein said ground conductor comprises braided tin/copper wires.

12. The heating jacket according to claim 8, wherein the means for holding the serpentine loops in spaced relation to one another comprises a plurality of fiberglass threads interwoven between said serpentine loops.

13. The heating jacket according to claim 8, wherein said heating element comprises a plurality of elongated, electrically connected strips secured to the inner liner in spaced relation to one another.

14. The heating jacket according to claim 1, which further comprises:

a pair of relatively opposing free edge portions for readily installing the jacket on and removing the jacket from the processing vessel; and readily releasable, cooperative fastening means attached to the outer cover adjacent to the free edge portions of the heating jacket.

* * * * *